United States Patent [19]

Crespy

[11] Patent Number: 4,553,926

[45] Date of Patent: Nov. 19, 1985

[54] HOLDER COMBINED WITH INSTRUMENT

[76] Inventor: Serge Crespy, P.O. Box 383, Collingwood, Ontario, Canada, L9Y 3Z7

[21] Appl. No.: 549,497

[22] Filed: Nov. 7, 1983

Related U.S. Application Data

[60] Continuation-in-part of Ser. No. 509,606, Jun. 30, 1983, Pat. No. 4,522,584, which is a division of Ser. No. 372,694, Apr. 28, 1982, abandoned.

[51] Int. Cl.[4] ..... F23Q 2/32; A63H 5/00

[52] U.S. Cl. ..... 431/253; 206/86; 446/81

[58] Field of Search ..... 431/156, 253, 343; 312/86, 73; 206/85, 86, 87; D21/64; D27/36, 38, 42; 7/160; 446/81

[56] References Cited

U.S. PATENT DOCUMENTS

| | | | |
|---|---|---|---|
| D. 156,639 | 12/1949 | Love | D27/38 |
| 256,738 | 4/1882 | Reckendorfer et al. | 7/160 |
| 2,043,888 | 6/1936 | Denit | 206/87 |
| 2,557,010 | 6/1951 | Reize | D27/36 |
| 4,000,812 | 1/1977 | Pisarski et al. | 206/87 |
| 4,121,375 | 10/1978 | Erickson et al. | 446/81 |
| 4,486,169 | 12/1984 | Lewis | 431/253 |

FOREIGN PATENT DOCUMENTS

| | | | |
|---|---|---|---|
| 4645 | 4/1879 | Fed. Rep. of Germany | 131/178 |
| 138287 | 3/1934 | Fed. Rep. of Germany | 7/160 |
| 495905 | 10/1919 | France | 431/253 |
| 1592729 | 7/1981 | United Kingdom | 431/253 |

*Primary Examiner*—Margaret A. Focarino

*Attorney, Agent, or Firm*—Kerkam, Stowell, Kondracki & Clarke

[57] ABSTRACT

A cigarette lighter holder has a pencil sharpener or a whistle and a set screw or other arrangement for holding a cigarette lighter within a cavity in the holder.

8 Claims, 11 Drawing Figures

HOLDER COMBINED WITH INSTRUMENT

CROSS REFERENCE TO RELATED APPLICATIONS

This application is a continuation-in-part application of co-pending U.S. patent application Ser. No. 509,606 filed on June 30, 1983 entitled Lighter Combined With Instrument now U.S. Pat. No. 4,522,584. That application is in turn a divisional application of its co-pending prior application Ser. No. 372,694 filed on April 28, 1982 and now abandoned.

BACKGROUND OF THE INVENTION

This invention relates to cigarette lighters holders. More particularly, this invention relates to cigarette lighter holders combined with other useful instruments, such as pencil sharpeners or whistles.

The prior art includes various structures for combining a lighter with a pen. The following patents are illustrative:

| U.S. Pat. No. | Inventor | Issue Date |
|---|---|---|
| 2,308,225 | Edenburg | Jan. 12, 1943 |
| 2,828,855 | Mosch | April 1, 1958 |
| 3,150,507 | Smith | Sept. 29, 1964 |

The Edenburg patent shows a lighter combined with a pen or pencil.

The Mosch patent shows a lighter combined with a pen, pencil, nail file, knife, screwdriver, can opener, or flashlight. The lighter may be combined with more than one of these implements. The implements which are combined with the lighter are interchangeably connected to a portion of the lighter body.

The Smith patent discloses a lighter combined with a pen, the lighter being specially constructed so as to avoid the use of a lid.

Other patents, such as the following, have shown cigarette lighters in combination with other devices:

| U.S. Pat. No. | Inventor | Issue Date |
|---|---|---|
| 2,921,495 | Ichikawa | Jan. 19, 1960 |
| 4,304,548 | Ruhaut et al | Dec. 8, 1981 |

The Ichikawa patent discloses a lighter having a built-in music box device.

The Ruhaut et al patent discloses a cigarette lighter combined with a key to facilitate the opening of frozen locks.

Previous patents further include the following:

| U.S. Pat. No. | Inventor | Issue Date |
|---|---|---|
| 256,738 | Boman et al | April 18, 1882 |
| 1,776,283 | Harasimiak | Sept. 23, 1930 |
| 4,247,283 | Vidas | Jan. 27, 1981 |

The Boman et al patent discloses a combined pencil point protector, twine cutter, and whistle.

The Harasimiak patent discloses a combined key and pencil sharpener.

The Vidas patent discloses a flaming trumpet or musical instrument whereby the musician may generate audience excitement by causing the trumpet to flame.

The Austrian patent No. 138,287 issued on July 10, 1934 discloses a cigarette lighter with a built-in pencil sharpener.

Although the above and other devices known heretofore have been generally useful, none of these devices is especially well suited for the disposable cigarette lighters which are common today. If a cigarette lighter is disposable, it is not especially economical to include another instrument built into the cigarette lighter housing.

SUMMARY OF THE INVENTION

Accordingly, it is a primary object of the present invention to provide a new and improved cigarette lighter holder.

A further object of the present invention is to provide a cigarette lighter holder in combination with a pencil sharpener.

A further object of the present invention is to provide a cigarette lighter holder in combination with a whistle.

These and other objects of the present invention are realized by a cigarette lighter holder comprising: a pocket-sized housing; an instrument housed in a lower portion of the housing, the instrument having an input hole for receiving an input, walls defining a transforming cavity for transforming the input received by way of the input hole, and an output hole for allowing an output to pass out from the transforming cavity; an open topped lighter cavity within the housing adapted to at least partially receive a cigarette lighter; and securing means to removably secure side walls of a cigarette lighter within the lighter cavity. The securing means may be fixed in position on one or more side walls of the lighter cavity. Alternately, the securing means may be adjustably mounted to one or more side walls of the lighter cavity. The securing means is operable to clampingly secure a cigarette lighter within the lighter cavity. The securing means may be realized by a set screw, a leaf spring within the lighter cavity, an elastomeric piece disposed within the lighter cavity, or at least one inwardly projecting portion on side walls of the cavity with the side walls of the cavity resiliently operable to clampingly secure a cigarette lighter in the lighter cavity by way of the inwardly projecting portion.

BRIEF DESCRIPTION OF THE DRAWINGS

The above and other features of the present invention will be more apparent when viewed in conjunction with the accompanied drawings wherein like characters represent like parts through out the several views and in which:

FIG. 11 shows a front view of a cigarette lighter holder having a whistle built in.

DETAILED DESCRIPTION OF THE PRESENT INVENTION

Figure 1:
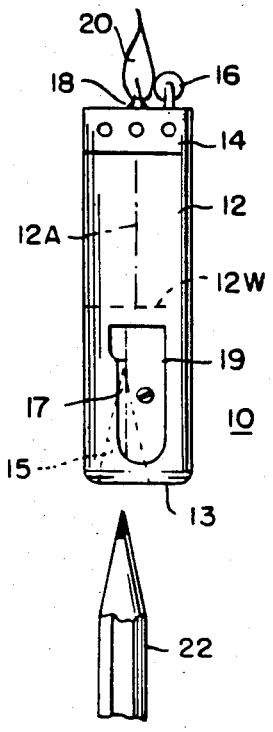
FIG. 1 shows a combined lighter and pencil sharpener.

FIG. 1 shows an article 10 combining a cigarette lighter and a pencil sharpener. The article 10 includes a housing 12, a cigarette lighter built in to the upper part of the housing 12, and a pencil sharpener built in to the lower part of the housing 12. The upper and lower parts of housing 12 are separated by wall 12W.

At the upper part of housing 12 there is a metallic portion 14 which may serve to protect the preferably plastic housing 12 from the lighter flame 20. A spark wheel 16 or similar actuator may be used to turn on and off flame 20 out of a nozzle 18. If desired, the flame 20 may be disposed on a wick (not shown) in a fashion well known in the art. The inner workings of the cigarette lighter may be made in a number of conventional ways and need not be discussed in detail. As an alternative to wall 12W, the lighter fluid may be disposed around the cone 15, and just inside the conical wall.

The lower part of the housing 12 includes a pencil sharpener having an input hole 13 for insertion of a pencil 22 into a transforming cavity 15. Upon rotation of the pencil 22 in the cavity 15, the pencil will be sharpened by the sharpening blade 13 attached to the housing 12. Shavings from the pencil will exit the transforming cavity 15 by way of an output hole 17. As shown, the walls of the housing 12 may extend sufficiently inward to define the transforming or sharpening cavity 15.

Figure 2:
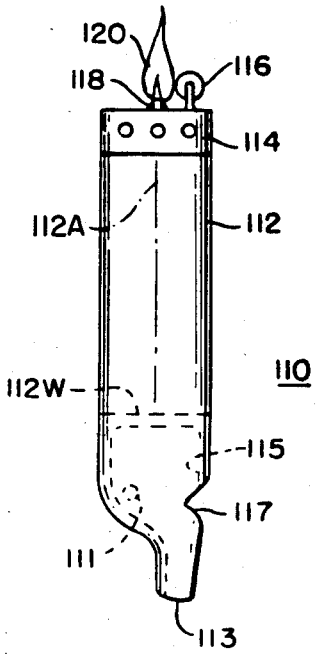
FIG. 2 shows a combined lighter and whistle.

Turning now to FIG. 2, a cigarette lighter combined with a whistle will be discussed. In particular, the parts of the FIG. 2 embodiment are numbered in the 100 series with the last two digits corresponding to the same part as with the FIG. 1 embodiment. For example, the article 110 has a housing 112 in a fashion generally corresponding to the article 10 and housing 12 of the FIG. 1 embodiment. Likewise, metallic portion 114, spark wheel or similar actuating device 116, nozzle 118 and flame 120 are constructed in a fashion identical to the FIG. 1 embodiment. Indeed, the upper part of housing 112 and the lighter parts above wall 112 W may be identical to the parts above wall 12W of FIG. 1.

The FIG. 2 article includes a whistle below the wall 112W as shown. The whistle includes an input hole 113, a resonant or transforming cavity 15, and an output hole 117. Additionally, a ball 111 may be used as is common in whistles.

The operation of the whistle in the FIG. 2 embodiment is relatively straight forward. A breath input is used as by having someone blow into the input hole 115. The cavity defined by walls 115, which are formed from the housing 112, and the dividing wall 112W, transforms the pressure input into a resonant frequency sound vibration output at output hole 117.

The housings 12 and 112 may be composed of plastic. In that case, the housings 12 or 112 may be molded at the same time as the molding of the transforming cavity defined by walls 15 or 115. Other materials could or course be used.

The lighter disposed within the upper portion of housing 12 or 112 could be refillable as by unscrewing portion 14. Any of numerous other known techniques for refilling the lighter may be used. Alternately, the lighter may be non-refillable in which case the article 10 or 110 could be simply be kept for use as either a pencil sharpener or a whistle.

The housing 12 or 112 may be cylindrical with its axis 12A or 112A extending lengthwise as shown.

Figure 3:
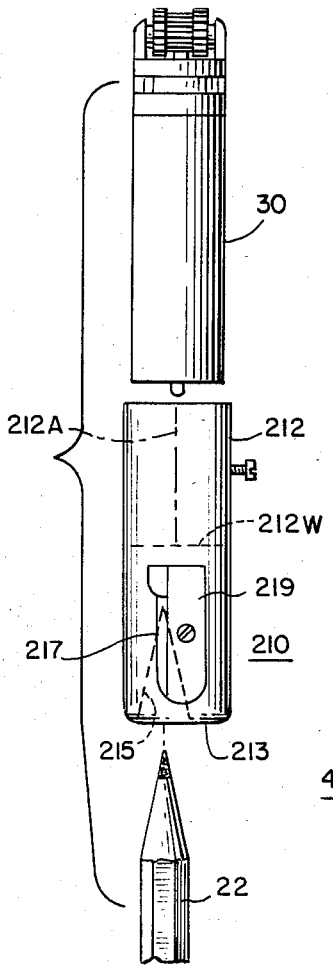
FIG. 3 shows a side view of a first embodiment cigarette lighter holder of the present invention.

FIG. 3 shows a conventional disposable cigarette lighter 30 directly above a cigarette lighter holder 210 according to the present invention. As will be readily noted, the labeled parts of cigarette lighter holder 210 correspond to the parts with the same last two digits as shown in the FIG. 1 combined cigarette lighter and pencil sharpener. Thus for example, the pencil sharpening blade 219 in FIG. 3 performs the same function as the pencil sharpener blade 19 in FIG. 1. However, unlike the cigarette lighter of FIG. 1, the holder of FIG. 3 includes an open topped lighter cavity 232 as best shown in the top view of FIG. 4. Specifically, this cavity 232 is shaped and sized to receive a conventional cigarette lighter 30. Once the cigarette lighter 30 is slid into place at least partially within the cavity 232, a set screw 234 may be tightened to secure the lighter in place. The set screw 234 operates as a securing means to removably secure side walls of the cigarette lighter within the lighter cavity. The cavity 232 may be sufficiently deep to receive substantially all of the cigarette lighter 30. Alternately, the cavity 232 could simply receive about the lower $\frac{1}{2}$ inch of the cigarette lighter.

Figure 5:
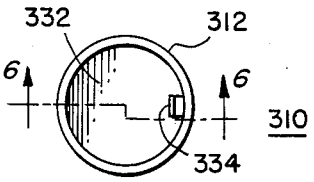
FIG. 5 shows a top view of a second embodiment cigarette lighter holder.
Figure 4:
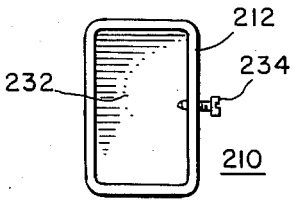
FIG. 4 shows a top view of the cigarette lighter holder of FIG. 3.

As shown in the top view of FIG. 4, the cavity 232 may have an oval cross section to accommodate a similarly shaped disposable cigarette lighter. Alternately, the embodiment of FIG. 5 shows a top view of a cigarette lighter holder 310 including a cylindrical lighter cavity 332 having walls 312. Such a cylindrical lighter cavity 332 may be used to accommodate commonly made cylindrical lighters.

Although the embodiment of FIG. 5 could include a set screw similar to the embodiment of FIG. 4, FIG. 5 shows an alternate arrangement whereby a leaf spring 334 is disposed within the cavity 332.

Figure 6:
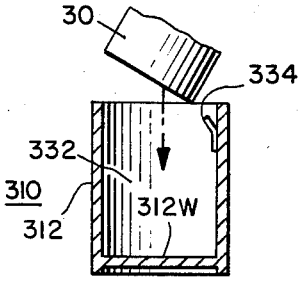
FIG. 6 shows a cross sectional side view along lines 6—6 of FIG. 5.
Figure 7:
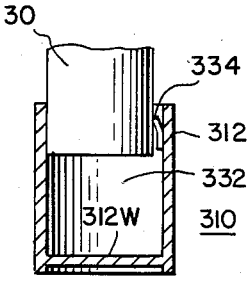
FIG. 7 shows a cross sectional side view also along lines 6—6 of FIG. 5 and with a cigarette lighter inserted partially within the cigarette lighter holder.

The operation of the leaf spring 334 will be readily apparent by reference to the FIGS. 6 and 7 which both show cross sectional side views taken along line 6—6 of FIG. 5. As shown in FIG. 6, the leaf spring 334 is fixed to the side walls 312 of the holder 310. The leaf spring 334 normally projects outwardly into the position shown in FIG. 6. However, when a cigarette lighter 30 is used to push the leaf spring 334 into the position shown in FIG. 7, the cigarette lighter 30 may be readily slid down into the cavity 332. The lighter 30 is shown partially inserted into the cavity 332 in the FIG. 7 view. The cigarette lighter 30 could be slid down until its bottom abuts the bottom wall 312W of the cavity 332. The leaf spring 334 could be molded, screwed, or otherwise attached to the preferable plastic walls of cavity 332.

Figure 8:
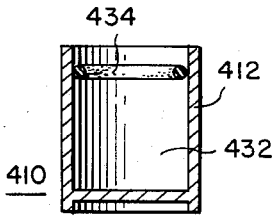
FIG. 8 shows a cross sectional side view with parts broken away of a third embodiment cigarette lighter holder according to the present invention.

FIG. 8 shows an alternate to the securing means 234 and 334 shown in the proceeding drawings. Specifially, the securing means 434 in FIG. 8 is a piece of rubber which extends around the cavity 432. When a cigarette lighter is inserted into the cavity 432 of the holder 410, the rubber piece 434 is compressed and therefore clampingly secures the cigarette lighter in the cavity 432. The securing means 434 may be realized by a piece of rubber which extends circumferentially around the cavity 432. Alternately, the securing means 434 may be realized by one or more separate rubber pieces within the cavity 432. The cavity 432 may be configured with the shape of the cavity of FIG. 4 or FIG. 5 or other shape suitable for insertion of a cigarette lighter.

Figure 9:
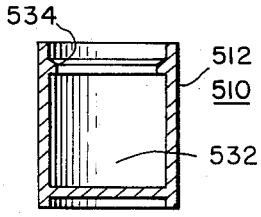
FIG. 9 shows a cross sectional side view with parts broken away of a fourth embodiment cigarette lighter holder according to the present invention.

Turning now to FIG. 9, an alternate securing means 534 will be discussed in detail. Specifially, the embodiment 510 of FIG. 9 includes side walls 512 around lighter cavity 532, the side walls 512 having inwardly projecting portion 534 which may be circumferentially disposed around cavity 532. The side walls 512 and the projecting portion 534, which is preferably integral with the side walls 512, are made of plastic. The lighter cavity 532 is shaped such that insertion of a disposable cigarette lighter will spread the walls apart such that their natural resilience tends to clamp any cigarette lighter placed in the cavity 532. The inwardly projecting portions 534 will press against the side walls of any inserted cigarette lighter to hold it in place.

Figure 10:
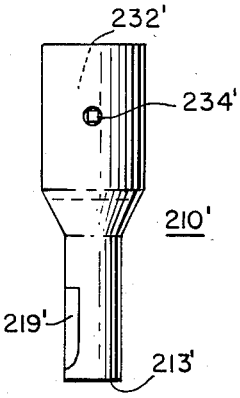
FIG. 10 shows a side view of a fifth embodiment cigarette lighter holder.

Turning now to FIG. 10, a side view of an alternate embodiment is shown. The embodiment 210 of the present invention may be configured to be cylindrical at its bottom portion and oval in cross section at its top portion and includes parts labeled with a prime. Alternately, the holder of the present invention may be configured by a holder which is cylindrical as with the combined cigarette lighter and sharpener of FIG. 1 or the combined cigarette lighter and whistle of FIG. 2.

Figure 11:
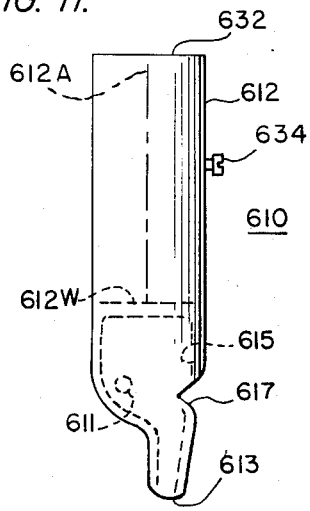

Turning now to FIG. 11, an alternate cigarette lighter holder 610 will be discussed. The holder 610 includes a whistle built into it, the parts generally being identified with the same last two digits as the corresponding parts on the FIG. 3 article. The open topped lighter receiving cavity 632 may be configured in the same fashion as any of the cavities shown in FIGS. 3–10. Although a set screw 634 is used as the securing means in the FIG. 11 embodiment, it will be readily understood that any of the securing means shown in the other drawings may also be used for holding the cigarette lighter in place.

As shown in FIG. 11, the whistle walls 615 are integral with the side wall portions 612 and the bottom wall 612W. The bottom wall 612W completely closes off the lighter cavity above from the breath input hole 613. Note also that the securing means such as set screw 634 (or any of the other securing means) operate in a clamping fashion so as to resist movement of the cigarette lighter out of the lighter cavity.

It will be readily appreciated that the various securing means all labeled with 34 as their last two digits are operable to clampingly secure a cigarette lighter within the corresponding lighter cavities all labeled with 32 as their last two digits. Additionally, the securing means 334, 434, and 534 are fixed to the corresponding side walls of the corresponding lighter cavities, whereas the securing means set screw 234 of FIG. 4 is adjustable in position. The rubber piece or pieces 434 shown in FIG. 8 embodiment may be considered more generally as an elastomeric piece disposed within the lighter cavity.

The various securing means 234, 334, 434, 534 and 634 may be arranged to clamp different size and/or different shape cigarette lighters. For example, a separate set screw (not shown) orthogonal to set screw 234 in FIG. 4 may be used to clamp a cigarette lighter in cavity 232 even though it is smaller than the width of cavity 232. Ihe rubber insert ring or piece 434 of FIG. 8 preferably designed to seat within a circumferential groove (not shown) in the wall of cavity 432. It may thus be removed and easily replaced by larger or smaller rubber pieces to adapt to different sized and shaped lighters.

As used herein an "instrument" shall refer to a tool, implement, or the like. A "transforming cavity" refers to a cavity which changes an input into a different form as, for example, an input of a dull pencil end may be transformed into a sharp pencil end.

Although various details of construction have been disclosed herein, these are for illustrative purposes only. Various modifications and adaptations will be readily apparent to those of ordinary skill in the art. Accordingly, the scope of the present invention should be determined by reference to the claims appended hereto.

What is claimed is:

1. A cigarette lighter holder comprising:

(a) a pocket sized housing;

(b) a whistle housed in a lower portion of said housing and having whistle walls, a breath input hole, a sound output hole, and a transforming cavity for transforming a breath input into a sound output, said breath input hole being on a first end of said housing;

(c) a lighter cavity within said housing and having an open top at a second end of said housing, said second end being opposite said first end, said lighter cavity shaped and adapted at least partially to receive a cigarette lighter, said lighter cavity bounded by closed side wall portions and by a bottom wall completely closing off said lighter cavity from said breath input hole, said side wall portions, bottom wall, and whistle walls all being integral portions of said said housing; and (d) securing means to clampingly secure side walls of a cigarette lighter within said lighter cavity, said securing means operable to resist movement of a cigarette lighter out of said lighter cavity.

2. The holder of claim 1 wherein said securing means is a set screw.

3. The holder of claim 1 wherein said securing means is a spring within said lighter cavity.

4. The holder of claim 1 wherein said spring is a leaf spring.

5. The holder of claim 1 wherein said securing means is an elastomeric piece disposed within said lighter cavity and operable to compress for clamping a cigarette lighter within said cavity.

6. The holder of claim 1 wherein said securing means includes at least one inwardly projecting portion on side walls of said cavity and said side walls are resiliently operable to clampingly secure a cigarette lighter in said lighter cavity by said inwardly projecting portion.

7. The holder of claim 1 wherein said securing means is fixed in position on one or more side walls of said lighter cavity.

8. The holder of claim 1 wherein said securing means is adjustably mounted to one or more side walls of said lighter cavity.

* * * * *